US006390806B1

(12) United States Patent
Dempsey et al.

(10) Patent No.: US 6,390,806 B1
(45) Date of Patent: May 21, 2002

(54) PNEUMATIC SYSTEM FOR FLAME ROLLOUT AND DRAFT SAFEGUARD PROTECTION

(75) Inventors: Daniel J. Dempsey, Carmel; Ninev Karl Zia, Indianapolis; Timothy J. Waterman, Carmel, all of IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/964,598

(22) Filed: Sep. 28, 2001

(51) Int. Cl.[7] ..... F23N 5/02

(52) U.S. Cl. ..... 431/21; 126/110 R; 126/116 A; 431/19; 431/20

(58) Field of Search ..... 126/110 R, 116 R, 126/112, 116 A, 287.5; 431/12, 19, 20, 21, 22, 89, 18; 122/504.1, 504.3

(56) References Cited

U.S. PATENT DOCUMENTS 3,650,262 A * 3/1972 Root et al. ..... 431/20
4,401,425 A * 8/1983 Gable et al. ..... 431/22
4,703,747 A * 11/1987 Thompson et al. ..... 126/112
4,729,207 A * 3/1988 Dempsey et al. ..... 126/110 R
5,993,195 A * 11/1999 Thompson ..... 431/20
6,109,255 A * 8/2000 Dieckmann et al. .... 126/116 R

* cited by examiner

*Primary Examiner*—James C. Yeung

(57) ABSTRACT

A furnace is provided with a flame rollout protection system which operates through an existing excess-air control pneumatic circuitry to shut down the furnace in the event of a flame rollout condition. A fusible tube is attached at its one end to the pneumatic system and extends into an area which will be exposed to hot gases in the event of a flame rollout condition. A melting of the tube by the hot gases causes the pressure therein to drop to ambient pressure such that of the pneumatic circuitry responsively causes the furnace to shut down. The tube is also extended to pass through an area which will be exposed to hot gases in the event of a blocked vent in the furnace, thereby causing a similar shut down of the furnace.

14 Claims, 3 Drawing Sheets

PNEUMATIC SYSTEM FOR FLAME ROLLOUT AND DRAFT SAFEGUARD PROTECTION

BACKGROUND OF THE INVENTION

This invention relates generally to residential furnaces and, more particularly, to a pneumatic approach for protecting against Flame rollout and blocked vent conditions.

Pressure drop sensing systems have been used in residential furnace heat exchangers since the early 1980s in order to verify or control the amount of excess air. The systems were based on the relationship of the heat exchangers pressure drop being proportional to excess air, with the system being prevented from operation if there is insufficient excess air. In variable speed inducer systems, the speed of the inducer motor is controlled in response to that pressure drop in order to maintain the desired level of excess air. Examples of such systems are described in U.S. Pat. Nos. 4,703,747 and 4,729,207, assigned to the assignee of the present invention. Such systems use one or more pressure switches to accomplish that function.

There are certain abnormal conditions that may occur in residential furnaces which cause undesirable high temperatures to exist in localized areas. One of those conditions is a flame rollout, which may occur at any location around the burners. Flame rollout is brought about by insufficient combustion air flow. The common approach for detecting a flame rollout condition is to provide one or more bimetal or fusible link switches in those positions in which of a flame rollout may occur, with the tripped switch then causing the furnace to shut down. With this approach, more than one switch may be required in order to provide the desired protection. This is particularly true in the case of a multipoise furnace, wherein the furnace (and the burners) may be placed in any one of four positions, thereby increasing the number of locations in which such a flame rollout is likely to occur. It can therefore be relatively expensive to equip the system with the required number of bimetal switches in order to obtain the desired protection.

Another undesirable condition that may occur to cause high temperatures is that of a blocked vent. If for some reason the flow of exhaust gases through the furnace vent is blocked, the temperatures in the vent area will rise to a higher than normal level. A common approach for addressing this condition is to provide a temperature switch in the area involved so as to sense a high-temperature condition and shut down the furnace. Typical of such an approach is shown in U.S. Pat. No. 4,401,425 assigned to the assignee of the present invention. While a single switch will normally meet the needs for this function, a multipoise furnace with its various possible orientations, can complicate the problem of proper location selection for the temperature sensing switch. In some applications, the temperature switch has been replaced with a pressure switch that senses the vent or inducer pressure to determine when there is a blocked vent condition to responsively shut down the furnace.

It is therefore an object of the present invention to provide an alternative method and apparatus for detecting a flame rollout condition in a furnace.

Another object of the present invention is to provide an alternative method and apparatus for detecting a blocked vent condition in the furnace, where temperature sensing means are used to detect a blocked vent.

Yet another object of the present invention is that of reducing the cost of providing protection against flame rollout conditions in a furnace.

These objects and other features of advantages become readily apparent upon reference to the following description when taken in conjunction with the appended drawings.

SUMMARY OF THE INVENTION

Briefly, in accordance with one aspect of the invention, the temperature sensing switch(es) is replaced with a pneumatic fusible element connected to the existing pressure sensing system in the furnace. The fusible element is strategically placed adjacent to the burners so as to be exposed to the high temperature in the event of a flame rollout or over temperature condition. The fusible element is composed of a material which melts and breaches at a predetermined temperature related to the flame rollout condition, such that, upon melting, the pressure therein goes to ambient to thereby shut down the furnace.

In accordance with another aspect of the invention, a pneumatic fusible element is strategically placed in the area in which the temperature would rise in the event of a blocked vent, and the fusible element is connected into the existing pressure sensing system of the furnace. The fusible element is composed of a material which melts and breaches at a predetermined temperature related to the higher temperature that would occur in the event of a blocked vent, such that, upon melting, the pressure therein goes to ambient to thereby shut down the furnace.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
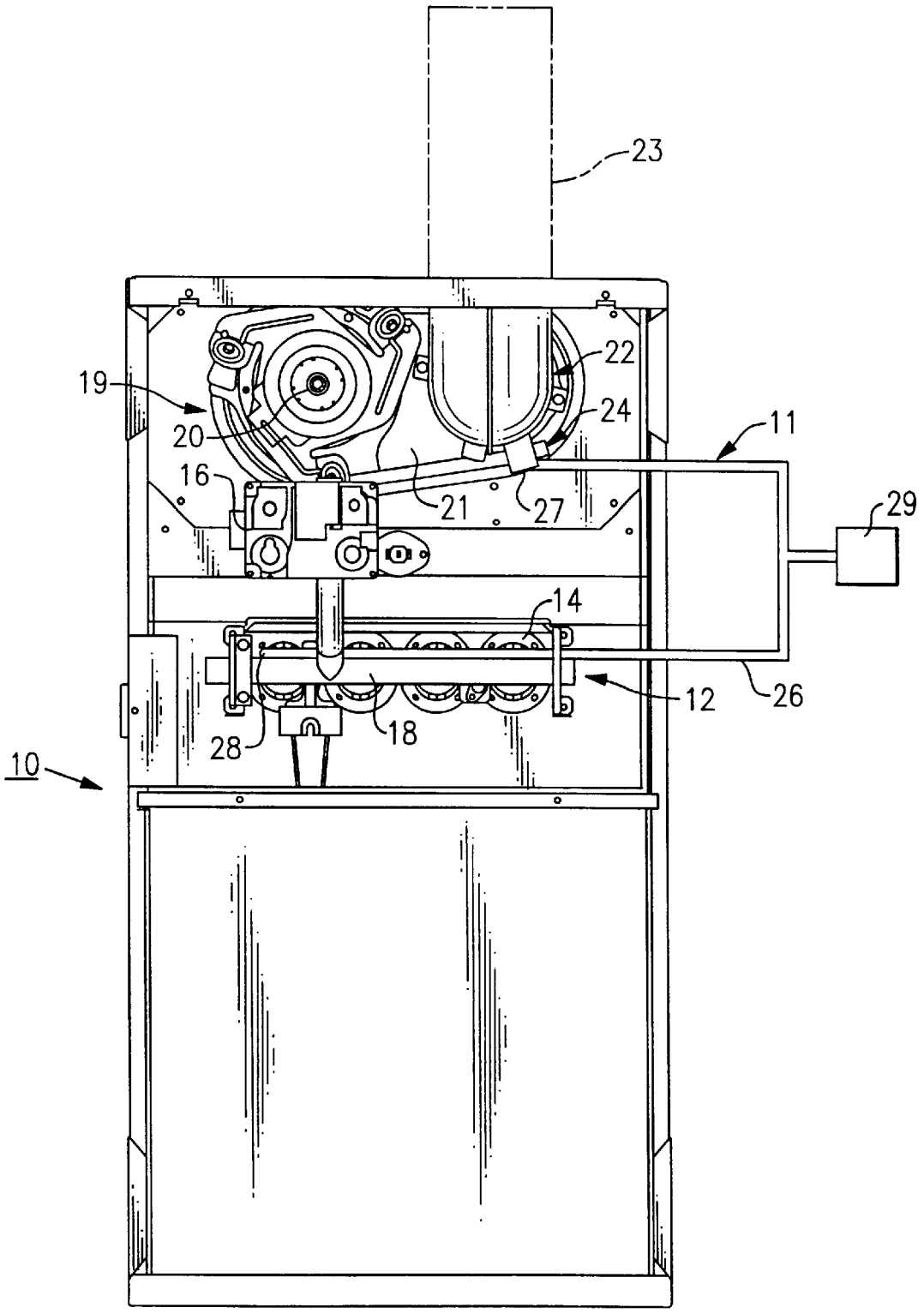
FIG. 1 is a front elevational view of a furnace with the present invention incorporated therein.

Referring now to FIG. 1, there is illustrated a gas-fired multipoise furnace 10 with the present invention incorporated therein as generally shown at 11. The furnace is shown in an upright position wherein the return air from the comfort region enters the lower part of the furnace and passes vertically in an upward direction through a bank of heat exchangers (not shown) in the upper part of the furnace prior to being returned to the comfort region.

Within the combustion circuit, there is provided at the one end, a burner assembly 12 having individual or ganged burners 14 that fire into respective heat exchanger panels for heating the air therein. A gas valve 16 provides gas to the burners 14 by way of a gas manifold 18. Operatively connected to the other end of the heat exchangers is an inducer 19 with its drive motor 20 and its housing 21 which act to draw the heated air through the heat exchangers and pass it through a vent elbow 22 to a flue pipe 23 to be discharged outside.

Associated with the vent elbow 22 is a flue gas sensor housing 24 which communicates with the flow of flue gas through the vent elbow 22 for the purpose of sensing a blocked vent condition and providing a draft safeguard feature as set forth in U.S. patent application Ser. No. (9777). In that application, a temperature limit switch is mounted within the housing 24 and operates to shut down the furnace in the event that there is a buildup of hot gases within the housing 24 as will occur when a blocked vent condition exists. In the present invention, however, this function is accomplished in a different manner as will be more fully described hereinafter.

In addition to the draft safeguard feature, the present invention is intended to also provide protection against a flame rollout condition within the vicinity of the burners 14. Both of these functions are accomplished by way of a pneumatic apparatus which includes a pneumatic fusible element or tube 26 having its one closed end 27 located in or near the flue gas sensor housing 24 and its other closed end 28 extending across the vicinity of the burners 14 as shown. The pneumatic fusible element 26 is operatively connected to a pressure switch 29, which has a primary function of verifying a desired level of excess air as set forth in U.S. Pat. No. 4,729,207, but which also serves to provide protection against vent blockage and flame rollout in accordance with the present invention. The pneumatic fusible element 26 is formed of a material which, when exposed to excessive temperatures, will melt and open the circuit to ambient pressure. In operation, when either a flame rollout condition exists within the vicinity of the burner assembly 12, or a blocked vent condition occurs to cause gas buildup in the flue gas sensor housing 24, the pneumatic fusible element 26 is caused to melt at that location and the pressure in the fusible element 26 drops to ambient conditions. The pressure sensor 29 then responsively shuts down the furnace. The furnace will remain shut down until a service person can investigate the matter and replace the pneumatic fusible element 26 and restart the furnace.

It should be recognized that the fusible element 26 and pressure sensor 29 are shown outside the furnace for purposes of clarity. In actuality both would be entirely within the furnace, and the pressure switch 29 would preferably be mounted within the inducer assembly 19.

Figure 2:
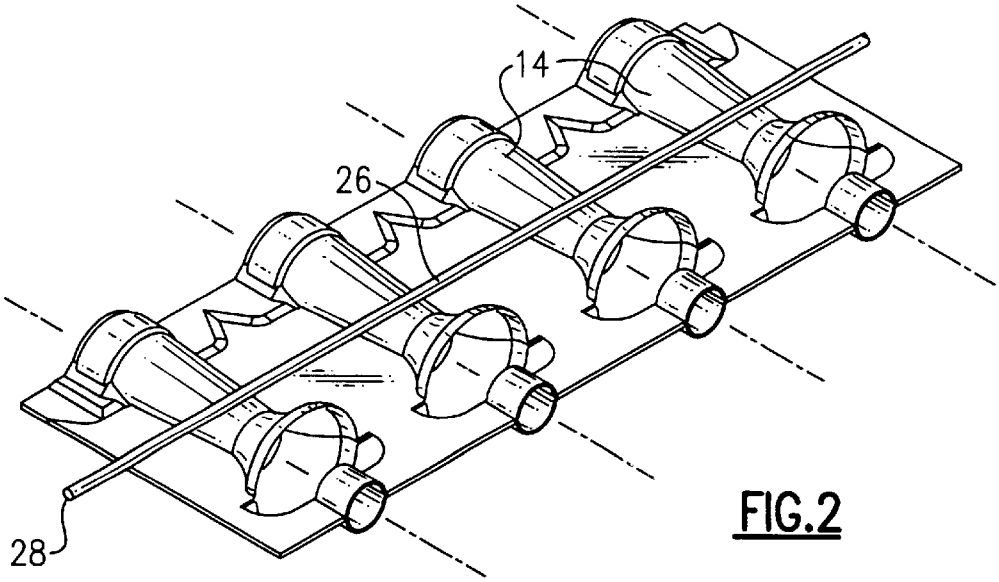
FIG. 2 is a perspective view of the burner portion thereof in accordance with one embodiment of the invention.

Considering further the flame rollout protection function, a brief discussion of the location of the pneumatic fusible element 26 is in order. In accordance with the prior art, it was necessary to provide at least one temperature sensor and switch at a location within the burner assembly where it would be exposed to the heat in the event of a flame rollout. With a multipoise furnace, however, it was generally necessary to provide more than one such sensor in order to ensure that a flame rollout condition was properly sensed. With the present invention, a single element, i.e. the pneumatic fusible element 26, can be used and can be selectively placed so as to insure sufficient coverage against the occurrence of any flame rollout condition. For example, it may be as long as necessary, and it may be routed in a wrap-around manner to any and all locations in which the prior art temperature sensors were placed. A simplified and effective approach of locating the pneumatic fusible element 26 adjacent the burners 14 is shown in FIG. 2. Here, the pneumatic fusible element 26 is placed in close proximity to each of the burners 14, such that if there is a flame rollout condition at any one of the burners 14, the pneumatic fusible element 26 will be caused to melt at that point, thereby causing a shutdown of the furnace.

Figure 3:
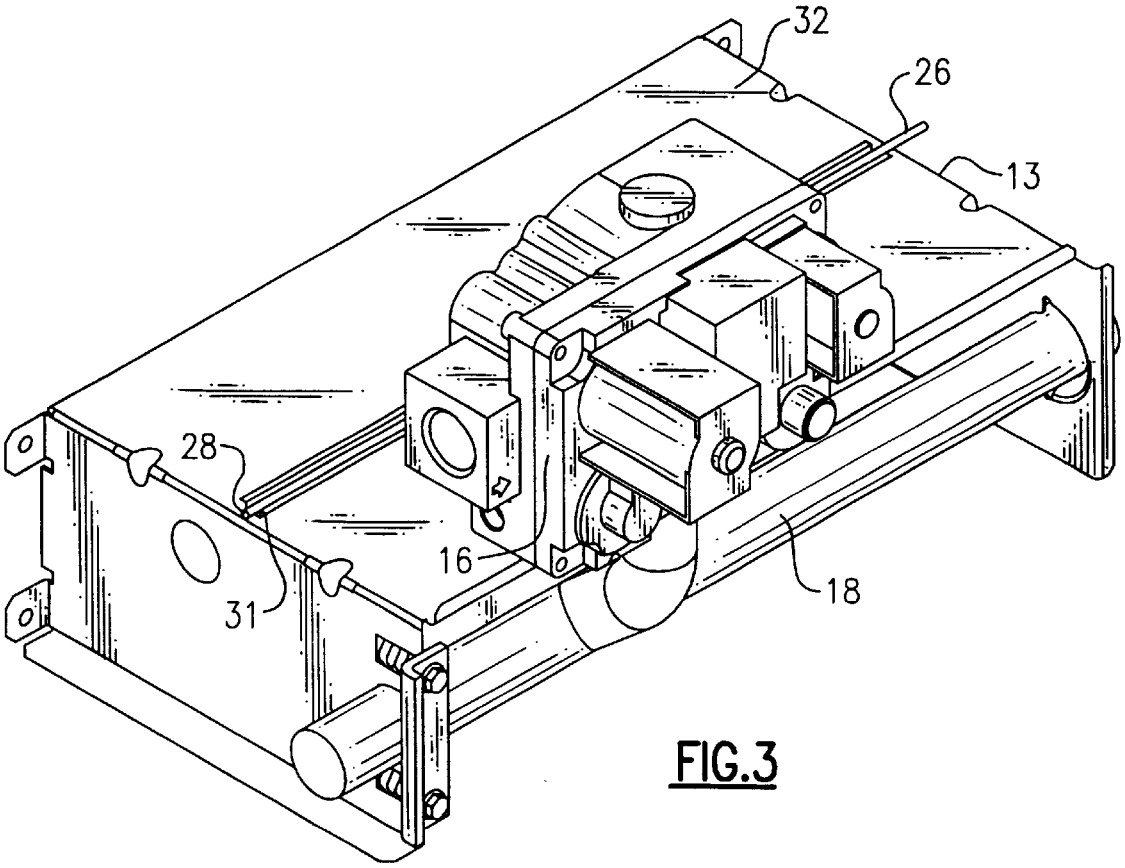
FIG. 3 is a perspective view of the burner assembly portion in accordance with another embodiment thereof.

Another possible location of the pneumatic fusible element 26 is that shown in FIG. 3, wherein the pneumatic fusible element 26 is placed on top of the burner assembly wrapper 13 as shown. A narrow slot 31 is formed in the top 32 of the assembly wrapper 13 such that the pneumatic fusible element 26 is exposed to that area within the burner assembly wrapper 13, just above the burners 14 (not shown). In this way, the pneumatic fusible element 26 will be exposed to the higher temperatures resulting from any flame rollout condition so as to shut down the furnace in the manner as described hereinabove. Other possible locations and orientations of the pneumatic fusible element 26 within the vicinity of the burner assembly wrapper 13 will occur to those skilled in the art and are contemplated in accordance with the present invention.

Figure 4A:
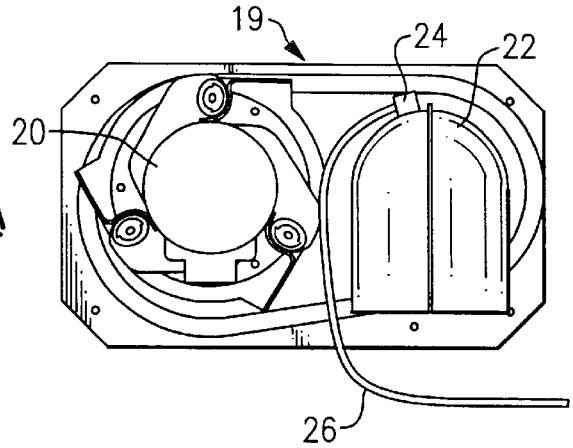
FIG. 4A and FIG. 4B are front views of the draft safeguard portion thereof.
Figure 4B:
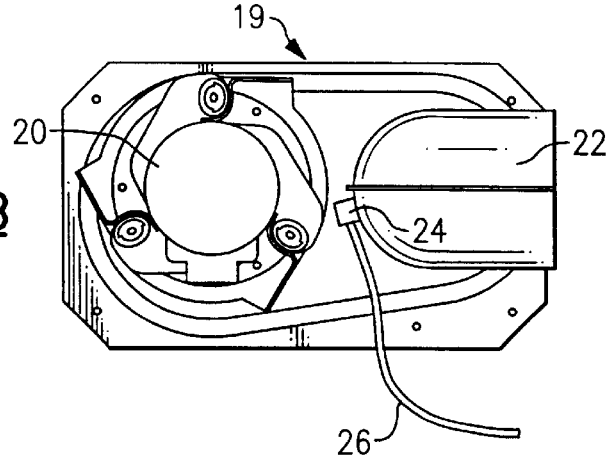

Referring again to the draft safeguard related feature of the subject invention, it will be recognized that the FIG. 1 embodiment shows the vent elbow 22 in an upwardly extending position that would be appropriate for either an upflow or a horizontal orientation of the firnace. FIG. 4A and FIG. 4B show the elbow 22 at alternative positions for purposes of accommodating different furnace orientations. In FIG. 4A, the vent elbow 22 is shown in a position that would be appropriate for a furnace which is in a downflow or horizontal orientation. In FIG. 4B, however, the vent elbow 22 is shown in a position that would be appropriate for a furnace which is in a horizontal left side down with side discharge, upflow or downflow orientation. In either case, it is necessary to extend the length of the pneumatic fusible element 26 as necessary to be coupled to the flue gas sensor housing 24 as shown.

In operation, the draft safeguard feature of the present invention is designed to protect against vent blockage in much the same way as the prior art approach, but in a substantially different manner. When a blockage occurs and a backup of flue gases builds up in the vent elbow 22, rather than a temperature sensor causing a switch to open, the pneumatic fusible element 26, which extends into the flue gas sensor housing 24, is caused to melt from exposure to the buildup of high-temperature gases to thereby cause the pressure sensor 29 to shut down the furnace.

Figure 5:
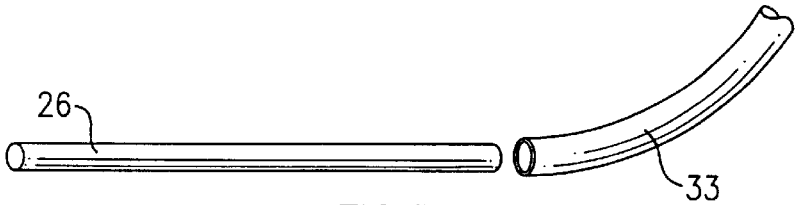
FIG. 5 is a plan view of the pneumatic fusible element portion thereof.

Referring now to FIG. 5, the pneumatic fusible element 26 is shown in a form to be inserted into a standard pressure tube 33, which is operably connected to the pressure sensor 29 in a manner as described above. The pneumatic fusible element 26 is composed of a material that is selected to melt at a predetermined temperature such as a thermoplastic or a thermo-elastomeric material. A material which has been found suitable for this purpose is polycarbonate (Lexan), which has a continuous use temperature of 257 degrees F. and a Deflection Temperature Under Load (DTUL) rating at 66 P.S. I of 280–345 degrees F. Another suitable material is polybutylene terephthalate (PBT), which is commercially available under the names Valox or Celanex, and which has a continuous use temperature of 284 degrees F. and a Deflection Temperature Under Load (DTUL) rating of 280–420 degrees F. Another possible material is a metallic material that has a low melting point.

Figure 6:
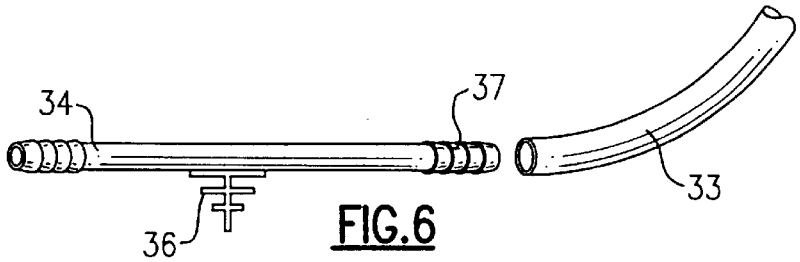
FIG. 6 is a plan view of an alternative embodiment thereof.

It should be recognized that, although the pneumatic fusible element has been described in terms of a flexible tube that may be wrapped around to the various locations as described hereinabove, it may also take other forms such as a formed conduit or the form of a molded fitting 34 as shown in FIG. 6, wherein the device 34 is a relatively short in length and is adapted to be located in the precise locations of use, with the pressure tube 33 then being used to extend and connect to the pressure sensor. The device 34 is formed of a thin membrane material selected to melt at the predetermined temperature in the same way as the pneumatic fusible element 26. Such a device may have a fitting 36 attached directly to it for purposes of mounting at to a sheet metal member. It may also have barbed fittings 37 for purposes of securely attaching the pressure tube 33. Other mounting methods will occur to one skilled in the art. For example, the device may be captured in "laces" in the burner enclosure or mounting flanges might be molded integral to the device.

What is claimed is:

1. In a furnace of the type having a combustion circuit including burners, heat exchangers and a pneumatic circuit for sensing the pressure drop within the combustion circuit, a system for responding to excessive temperatures that may result from undesirable operating conditions, comprising:

a fusible element located in a position within an area in which the excessive temperatures might occur, said fusible element being attached at one end into the pneumatic circuit and being composed of a meltable material, such that, if an excessive temperature occurs in said area, the fusible element will melt and the pressure within the element will go to ambient pressure thereby causing the furnace to shut down.

2. A system as set forth in claim 1 wherein said fusible element is positioned adjacent at least one burner to detect a flame rollout condition.

3. A system as set forth in claim 1 wherein said fusible element is positioned near an area in which hot gases would accumulate if a blocked vent condition were to exist.

4. A system as set forth in claim 1 wherein said fusible element is composed of a thermoplastic material.

5. A system as set forth in claim 1 wherein said fusible element is composed of the thermoelastomeric material.

6. A flame rollout protection system for a furnace of the type having at least one burner that is susceptible to a flame rollout condition, comprising:

a pneumatic system which operates at a pressure other than ambient pressure during periods of normal furnace operation;

means for sensing the pressure in said pneumatic system and for shutting down the furnace operation if the pressure in said pneumatic system falls outside of a predetermined pressure range; and said pneumatic system including a fusible element section composed of a material which, when exposed to a flame rollout condition, will partially melt and cause the pressure in the fusible element section to go towards ambient pressure such that the sensing means responsively shuts down the furnace operation.

7. A protection system as set forth in claim 6 wherein said fusible element section is positioned near at least one burner.

8. A protection system as set forth in claim 6 wherein said fusible element section is composed of a thermoplastic material.

9. A protection system as set forth in claim 6 wherein said fusible element section is composed of a thermoelastomeric material.

10. A protection system as set forth in claim 6 wherein said pneumatic system also includes a fusible element section positioned in an area which will be exposed to hot gases in the event of a blocked vent condition in said furnace, said fusible element section being caused by said hot gases to partially melt and cause the pressure in said fusible element section to go towards ambient pressure such that the sensing means responsively shuts down the furnace operation.

11. A furnace of the type having burners, heat exchangers and a pneumatic circuit for sensing the pressure drop across the heat exchangers for purposes of determining if there is sufficient air to data support combustion, comprising:

a pressure tube connected to the pneumatic circuit and extending across an area near the burners where the temperatures will substantially increase in the event of flame rollout from said burners, said pressure tube being composed of a material which, in the event of a flame rollout, will melt to open the tube to atmospheric pressure so as to thereby cause the pneumatic circuit to shut down the furnace.

12. The furnace as set forth in claim 11 wherein said pressure tube is composed of a thermoplastic material.

13. A furnace as set forth in claim 11 wherein said pressure tube is composed of a thermoelastomeric material.

14. A furnace is set forth in claimed 11 wherein said pressure fusible element also extends across an area that would be exposed to hot gases in the event of a blocked vent in said furnace such that said pressure tube will be caused by said hot gases to partially melt and cause the pressure in said pressure tube to go towards ambient pressure thereby causing said pneumatic circuit to shut down the furnace operation.

* * * * *